US006601496B1

(12) United States Patent
Kalashnikov et al.

(10) Patent No.: US 6,601,496 B1
(45) **Date of Patent: *Aug. 5, 2003**

(54) MAGAZINE FOR FIREARMS

(75) Inventors: Viktor M. Kalashnikov, Pastukhova (RU); Alexei E. Dragunov, Lenina (RU); Nikolai A. Bezborodov, Udmurtskava (RU); Vladislav N. Baranov, Baranov (RU)

(73) Assignees: Otkrytoe Aktsionernoe Obschestvo "Izltmash", Izhevsk (RU); Zakrytoe Aktsionernoe Obschestvo "Ruspa-M", Moscow (RU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/623,838

(22) PCT Filed: Jan. 12, 1999

(86) PCT No.: PCT/EA99/00001

§ 371 (c)(1),
(2), (4) Date: Nov. 27, 2000

(87) PCT Pub. No.: WO00/42374

PCT Pub. Date: Jul. 20, 2000

(51) Int. Cl.[7] ..... F41A 9/03

(52) U.S. Cl. ..... 89/33.02; 89/34; 89/33.17; 42/49.01

(58) Field of Search ..... 89/33.02, 33.16, 89/33.17, 34; 42/49.01

(56) References Cited

U.S. PATENT DOCUMENTS

| | | | | | |
|---|---|---|---|---|---|
| 1,333,498 A | * | 3/1920 | Lang | ..... | 89/33.02 |
| 4,207,797 A | * | 6/1980 | Gyorik | ..... | 89/34 |
| 4,766,800 A | * | 8/1988 | Miller et al. | ..... | 89/33.02 |
| 4,888,898 A | | 12/1989 | Miller et al. | ..... | 42/49.01 |
| 4,945,664 A | | 8/1990 | Miller | ..... | 42/49.01 |
| 5,335,579 A | * | 8/1994 | David | ..... | 89/34 |

FOREIGN PATENT DOCUMENTS

| | | | | | |
|---|---|---|---|---|---|
| DE | 1553877 | * | 8/1971 | ..... | 89/33.02 |
| DE | 38 09 319 | | 9/1989 | | |
| EP | 0 365 145 | | 4/1990 | | |
| RU | 2 037 125 | * | 6/1995 | | |
| RU | 2037125 C1 | | 6/1995 | | |
| RU | 2089812 | | 10/1995 | | |
| RU | 2089812 C1 | | 9/1997 | | |
| RU | 2094731 C1 | | 10/1997 | | |
| RU | 2 094 731 | * | 10/1997 | | |
| WO | 94/12842 | * | 6/1994 | ..... | 89/33.02 |

* cited by examiner

*Primary Examiner*—Stephen M. Johnson
(74) *Attorney, Agent, or Firm*—Christie, Parker & Hale, LLP

(57) ABSTRACT

A magazine for a firearm having a cylindrical housing with rear and front covers and with a smooth inner surface is provided. A hollow cylinder rigidly secured to the rear cover is arranged inside the housing. A helix is formed on the outer surface of the cylinder. A separator adapted for rotation is positioned inside the housing between the housing inner surface and the helix. Longitudinal grooves are formed on the separator. A cartridge remover is secured on the rear end of the cylinder. A spring is arranged inside the cylinder. One end of the spring is rigidly connected to the rear cover, the other to the front cover. A filler is secured in the upper rear part of the housing, and a feeder is arranged in the longitudinal grooves of the separator. A casing with a protrusion for securing the magazine on the firearm is secured to the front part of the housing.

18 Claims, 1 Drawing Sheet

MAGAZINE FOR FIREARMS

BACKGROUND OF THE INVENTION

The invention relates to firearms.

A magazine for a firearm is known that comprises a cylindrical housing with front and rear covers and a helix on the inner surface, a separator with grooves, which is positioned inside the housing, a spring positioned inside the separator and at one end rigidly connected to one of the covers that is secured to the housing, and a filler [1].

Drawbacks of the analog are:

- the helical form of the separator grooves, which results in a more complex construction and reduction of reliability of the device;
- the two-row arrangement of the cartridges in the separator may result in seizure of the separator during firing and it excludes the possibility of using cartridges with flanges;
- the inconvenience of loading the magazine, which is due to the necessity of preliminarily coiling the spring and subsequently pushing the cartridges through the filler to overcome the friction force in the two-row arrangement.

A magazine for a firearm is known which comprises a cylindrical housing with rear and front covers and with a helix on its inner surface a separator with grooves which is positioned inside the housing, a spring that is arranged inside the separator and has one of its ends rigidly connected to one of the covers which is secured to the housing, a filler and an aiming device fixed on the housing of the magazine [2]. The drawbacks of this analog are the same as indicated above in respect to analog [1]. Furthermore, fixing the aiming device on the housing of the magazine reduces the accuracy of aiming because of the large spatial separation between the aiming line and the axis of the barrel of the firearm, and also the inexact mounting of the aiming device, since the magazine itself is not exactly mounted.

A magazine for a firearm is known which comprises a cylindrical housing with rear and front covers and a helix on its inner surface, a separator with longitudinal grooves that is positioned inside the housing and mounted in precision bearings, a spring arranged inside the separator and having one end rigidly connected to the one of the covers of the housing that is secured to the housing, and a filler [3].

Drawbacks of the analog are:

- the inconvenience of loading the magazine, which is due to the necessity of preliminarily coiling the spring and subsequently pushing the cartridges through the filler, overcoming substantial friction forces;
- the insufficient reliability of the device, which is due to the presence of precision bearings and the possibility of seizure of the separator because of the absence of a magazine loading limiter.

The most similar analog (prototype) is the magazine for a firearm comprising a hollow cylindrical housing with a helix on its inner surface, a rear cover, a front cover with a catch and casing, a separator with longitudinal grooves and positioned inside the housing, a spring with its ends rigidly secured to the front and read covers, a filler and a feeder [4].

Drawbacks of the prototype are:

- the technological complexity of manufacturing the helix on the inner surface of the housing;
- that it is not possible to use cartridges with a flange in view of the fact that their distortion and seizure are possible.

SUMMARY OF THE INVENTION

The main object of the invention is to reduce the labor input in the production of the magazine and to improve the reliability of operation of the device when using cartridges both with and without a flange.

The stated object is attained in that in a magazine for a firearm comprising a hollow cylindrical housing, a front cover with a catch and a casing, a rear cover, a spring rigidly secured to the front and rear covers, a separator having longitudinal grooves and positioned inside the hollow cylindrical housing, a filler and a feeder, the inside of the hollow cylindrical housing is made smooth, wherein the hollow cylinder is rigidly connected to the rear cover, and a protrusion is made on the casing for securing the magazine on the firearm. A cartridge remover is secured on the rear end of the hollow cylinder.

In particular cases of realization of the device, a casing may be mounted on the front end of the housing, the casing limiting longitudinal movement of the separator and having a protrusion for mounting the front end of the housing on the firearm.

The technical result provided by the invention is expressed by enhancement of reliability, a reduction of the labor input during production and the possibility of using a cartridge with a flange.

BRIEF DESCRIPTION OF THE DRAWINGS

The essence of the invention is illustrated by the drawings in which.

DETAILED DESCRIPTION

Figure 1:
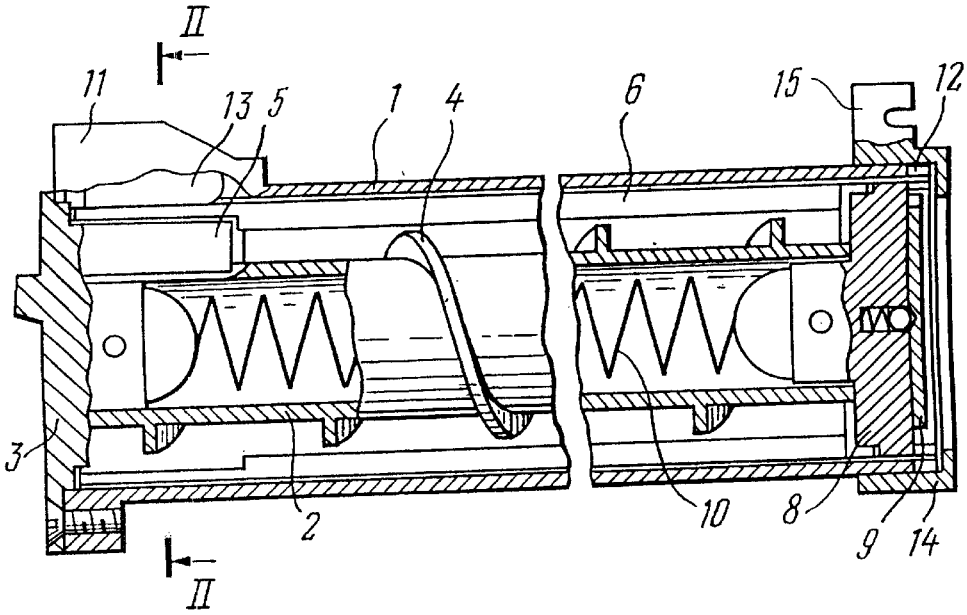
FIG. 1 shows a vertical longitudinal section of the magazine.
Figure 2:
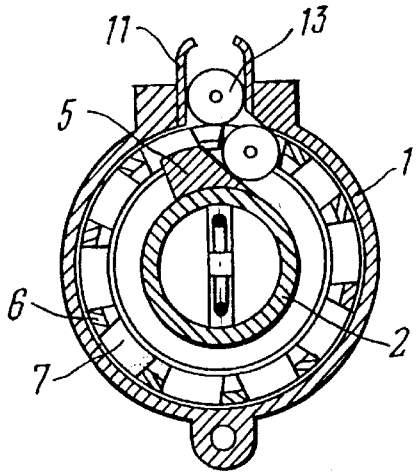
FIG. 2 shows a cross section of the filler of the magazine.

A magazine for a firearm comprises a hollow cylindrical housing 1 with a smooth inner surface. A hollow cylinder 2 is arranged in the housing 1 with a gap. The hollow cylinder 2 is immovably connected to a rear cover 3 secured to the housing 1. A helix 4 is made on the outer surface of the cylinder 2.

A cartridge remover 5 is immovably secured to the rear end of the inner cylinder 2 in the upper part thereof, between turns of the helix 4. A cylindrical separator adapted for rotation is arranged in the housing 1 between its inner surface and the cylinder 2. Through grooves 7, positioned along the circumference, are made in the walls of the separator. A front cover 8 with a catch 9 adapted for rotation together with the separator 6 is arranged in the front end part of the separator 6. A spring 10, its rear end secured to the rear cover 3, its front end to the front cover 8, is arranged inside the cylinder 2. A filler 11, fixed immovably relative to the housing 1 by means of the rear cover 3, is positioned in the rear top part of the housing 1. Grooves 12, with which the catch 9 of the front cover 8 interacts, are made on the front end of the housing 1. The grooves 12 are uniformly distributed over the circumference and their number corresponds to the number of grooves 7 in the separator 6. A feeder 13 is freely mounted in one of the longitudinal grooves 7 of the separator 6. The feeder 13 is located at the input to the filler in the absence of cartridges in the magazine and hinders uncoiling of the spring. A casing 14, which eliminates the possibility of chance disassembly of the magazine, is secured on the front end of the housing 1. A protrusion 15, by means of which the magazine is secured to the firearm, is made on the casing 14.

Operation of the device is carried out in the following manner.

In order to charge the magazine, it is taken in the left hand at the bottom in the region of the filler 11. Using the right hand, the catch 9 together with the front cover 8 is turned to the position ensuring engagement of the catch 9 with one of the grooves 12 made on the front end part of the housing 1 of the magazine. The separator 6 turns together with the cover and in turn retracts the feeder 13 from the filler 11, freeing a place for a cartridge.

A cartridge is put in the filler 11 and the front cover 8 with the catch is turned again, the catch drops into the next groove on the end of the housing, the separator moves the cartridge from the filler, freeing a place for the next cartridge. These actions continue until the feeder 13 does not abut against the front wall of the groove 7 of the separator 6. After this the catch 9 is shifted to the position in which it gets out of engagement with the grooves 12. In this position the spring 10 passes force through the front cover 8 to the separator 6, pressing the cartridge to the filler 11. The magazine thus charged is ready for firing. It is connected to the firearm, then the bolt (not shown in the drawing) is drawn back to the rear position and released. The bolt, moving forward, pushes the cartridge from the filler 11 along the remover and feeds it into the barrel. Wherein, the separator 6 turns under the action of the spring 10, feeding the next cartridge into the filler 11. This continues until the last cartridge is put on the sending line and the feeder is right next to the filler. The remaining elements perform auxiliary functions, in combination providing reliable operation of the magazine. The longitudinal grooves 7 of the separator 6 and the helix 4 of the cylinder 2 regulate the mutual positioning and movement of the cartridges during the charging of the magazine and during the firing. The front cover 8 serves to transmit the force of the spring 10 to the separator 6, and also for mutual action between the catch 9 and the grooves 12 on the end part of the housing 1. The rear cover 3 serves for securing parts of the magazine, the inner cylinder 2 and the spring 9. The casing 14 limits axial displacement of the separator 6, the front cover 8 and eliminates chance disassembly of the magazine. The protrusion 15 of the casing 14 serves to fix the magazine on the firearm. The remover 5 serves to feed cartridges into the filler 11.

Thus, use of the invention makes it possible in respect to the prototype to reduce the labor of producing the magazine and to improve the reliability of its operation when cartridges are used with or without flanges.

Sources of information:

| | | |
|---|---|---|
| 1. U.S. Pat. No. | 4888898, IPC F 41 C 75/10 | 26 Dec. 1989 |
| 2. U.S. Pat. No. | 4945664, IPC F 41 A 9/75 | 7 Aug. 1990 |
| 3. Application FRG | 3809319, IPC F 41 C 25/10 | 28 Sep. 1989 |
| 4. Application Russia | 95117040/08 (029712) | 6 Oct. 1995 |

What is claimed is:

1. A magazine for a firearm, comprising:

a hollow cylindrical housing having a smooth inner surface;

a front cover with a catch and a casing, the casing having a protrusion for securing the magazine to the firearm;

a rear cover;

a spring connected to the front cover and the rear cover;

a separator having longitudinal grooves, wherein the separator is positioned inside the hollow cylindrical housing;

a filler;

a feeder;

a hollow cylinder mounted inside the hollow cylindrical housing and rigidly connected to the rear cover, wherein a gap is formed between the inner surface of the housing and the cylinder;

a helix formed on an outer surface of the hollow cylinder; and a cartridge remover secured on a rear end of the hollow cylinder, wherein the separator is positioned between the hollow cylinder and the inner surface of the hollow cylindrical housing, and wherein the longitudinal grooves are arranged along a circumference of the separator.

2. A magazine for a firearm, comprising:

a hollow cylindrical housing having a longitudinal axis;

a cylinder with a helix on an outer surface thereof, the cylinder being fixedly mounted inside the housing and defining a gap relative to an inner surface of the housing;

a separator with a plurality of longitudinal grooves extending along an axis generally parallel to the longitudinal axis of the housing, each groove for housing a cartridge of the firearm longitudinally between turns of the helix, the separator being rotatably mounted inside the housing and over the cylinder;

a spring connecting the separator with at least one of the housing and the cylinder;

a filler secured at one end of the housing;

a feeder freely mounted in one of the grooves; and a cartridge remover secured on the cylinder under the filler and allowing passage of the feeder into the filler.

3. A magazine according to claim 2, wherein the cylinder is hollow and the spring is located inside the cylinder.

4. A magazine according to claim 2, further comprising a rear cover, the rear cover being secured both to the cylinder and the housing.

5. A magazine according to claim 4, wherein the spring is connected to the rear cover.

6. A magazine according to claim 2, further comprising:

a plurality of grooves provided on one end of the housing;

a front cover being secured to the cylinder; and a catch provided on the front cover, the catch being engageable with the grooves provided on the housing.

7. A magazine according to claim 6, wherein the spring is connected to the front cover.

8. A magazine according to claim 6, wherein the number of the grooves provided on the housing is equal to a number of the longitudinal grooves of the separator.

9. A magazine according to claim 6, further comprising a casing secured to the housing over the front cover.

10. A magazine according to claim 2, further comprising a protrusion for securing the magazine to the firearm.

11. A magazine for a firearm, comprising:

a hollow cylindrical housing;

a cylinder with a helix on an outer surface thereof, the cylinder being fixedly mounted inside the housing and defining a gap relative to an inner surface of the housing;

a separator with a plurality of longitudinal grooves, the separator being rotatably mounted inside the housing and over the cylinder;

a spring connecting the separator with at least one of the housing and the cylinder;

a plurality of grooves provided on one end of the housing;

a front cover being secured to the cylinder; and a catch provided on the front cover, the catch being engageable with the grooves provided on the housing.

12. A magazine according to claim 11, wherein the spring is connected to the front cover.

13. A magazine according to claim 11, wherein the number of the grooves provided on the housing is equal to a number of the longitudinal grooves of the separator.

14. A magazine according to claim 11, further comprising a casing secured to the housing over the front cover.

15. A magazine for a firearm, comprising:

a hollow cylindrical housing having a longitudinal axis;

a cylinder with a helix on an outer surface thereof, the cylinder being fixedly mounted inside the housing and defining a gap relative to an inner surface of the housing;

a separator with a plurality of longitudinal grooves extending along an axis generally parallel to the longitudinal axis of the housing, each groove for housing a cartridge of the firearm longitudinally between turns of the helix, the separator being rotatably mounted inside the housing and over the cylinder;

a spring connecting the separator with at least one of the housing and the cylinder;

a plurality of grooves provided on one end of the housing;

a front cover being secured to the cylinder; and a catch provided on the front cover, the catch being engageable with the grooves provided on the housing.

16. A magazine according to claim 15, wherein the spring is connected to the front cover.

17. A magazine according to claim 15, wherein the number of the grooves provided on the housing is equal to a number of the longitudinal grooves of the separator.

18. A magazine according to claim 15, further comprising a casing secured to the housing over the front cover.

* * * * *

UNITED STATES PATENT AND TRADEMARK OFFICE

CERTIFICATE OF CORRECTION

PATENT NO. : 6,601,496 B1
DATED : August 5, 2003
INVENTOR(S) : Kalashnikov et al.

It is certified that error appears in the above-identified patent and that said Letters Patent is hereby corrected as shown below:

Title page,
Item [75], Inventors, delete "Nikolai A. Bezborodov, Udmurtskava (RU); Vladislav N. Baranov, Baranov (RU )", insert -- Nikolai A. Bezborodov, Udmurtskaya (RU); Vladislav N. Baranov, Malaya Bronnaya (RU) --.
Item [73], Assignee, delete ""Izltmash"", insert -- "Izhmash" --.

Signed and Sealed this

Sixteenth Day of May, 2006

JON W. DUDAS
*Director of the United States Patent and Trademark Office*